US010998660B2

(12) United States Patent
Chen

(10) Patent No.: US 10,998,660 B2
(45) Date of Patent: May 4, 2021

(54) CONNECTOR ASSEMBLY

(71) Applicant: LOTES CO., LTD, Keelung (TW)

(72) Inventor: Yu Sheng Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/776,898

(22) Filed: Jan. 30, 2020

(65) Prior Publication Data

US 2020/0295489 A1 Sep. 17, 2020

(30) Foreign Application Priority Data

Mar. 11, 2019 (CN) ..... 201910180330.6

(51) Int. Cl.

| | |
|---|---|
| ***H01R 13/11*** | (2006.01) |
| ***H01R 12/71*** | (2011.01) |
| ***H01R 13/6582*** | (2011.01) |
| ***H01R 13/6594*** | (2011.01) |

(52) U.S. Cl.

CPC ..... *H01R 13/111* (2013.01); *H01R 12/718* (2013.01); *H01R 13/6582* (2013.01); *H01R 13/6594* (2013.01)

(58) Field of Classification Search

CPC ..... H01R 24/50; H01R 13/11; H01R 12/718
USPC ..... 439/63 NA
See application file for complete search history.

(56) References Cited

U.S. PATENT DOCUMENTS 3,639,892 A * 2/1972 Dill ..... H01R 13/53 439/607.01
4,961,709 A * 10/1990 Noschese ..... H01R 13/2421 439/591
5,380,211 A * 1/1995 Kawaguchi ..... H01R 4/30 439/74
5,928,000 A * 7/1999 Rudisill ..... H01R 13/2471 439/63
6,231,352 B1 * 5/2001 Gonzales ..... H01R 12/52 439/66
6,758,680 B2 * 7/2004 Duquerroy ..... H01R 24/50 439/63

(Continued)

FOREIGN PATENT DOCUMENTS

CN 108736226 A 11/2018

*Primary Examiner* — Neil Abrams
(74) *Attorney, Agent, or Firm* — Locke Lord LLP; Tim Tingkang Xia, Esq.

(57) ABSTRACT

A connector assembly includes a first electronic component, an electrical connector and a shielding shell fixed to the first electronic component, a second electronic component located above the first electronic component, and a mating member fixed to the second electronic component. The electrical connector includes an insulating body, and a first terminal electrically connected to the first electronic component. The mating member includes a second terminal electrically connected to the second electronic component. The shielding shell has a first grounding portion and a second grounding portion, and covers outside the first terminal. The first grounding portion is electrically connected to the first electronic component. When the mating member is downward mated with the electrical connector, the second terminal is inserted into the shielding shell to be mated with the first terminal, and the second grounding portion abuts the second electronic component to be electrically connected to the second electronic component.

29 Claims, 8 Drawing Sheets

(56) References Cited

U.S. PATENT DOCUMENTS

| | | | | |
|---|---|---|---|---|
| 6,776,668 | B1 * | 8/2004 | Scyoc | H01R 13/2421 439/295 |
| 7,118,383 | B2 * | 10/2006 | Nagata | H01R 13/6315 439/63 |
| 7,416,418 | B2 * | 8/2008 | Berthet | H01R 24/50 439/66 |
| 8,419,463 | B2 * | 4/2013 | Taguchi | H01R 13/504 439/449 |
| 8,851,904 | B2 * | 10/2014 | Chang | H05K 7/10 439/71 |
| 9,011,163 | B2 * | 4/2015 | Ohsaka | H01R 12/57 439/63 |
| 9,059,545 | B2 * | 6/2015 | Mason | H01R 13/2421 |
| 9,065,186 | B2 * | 6/2015 | Perrin | H01R 12/714 |
| 10,249,968 | B2 * | 4/2019 | Dandl | H01R 12/7082 |
| 10,320,132 | B2 * | 6/2019 | Zeng | H01R 12/707 |
| 10,446,955 | B2 * | 10/2019 | Hoyack | H01R 13/658 |
| 10,483,669 | B2 * | 11/2019 | Petit | H01R 13/6471 |
| 10,790,624 | B2 * | 9/2020 | Wang | H01R 12/91 |
| 2020/0295489 | A1 * | 9/2020 | Chen | H01R 13/6582 |

* cited by examiner

5

100

100

100

CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN201910180330.6 filed in China on Mar. 11, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a connector assembly, and particularly to a connector assembly easy for mating and has good shielding performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, a board-to-board connector assembly includes a socket and a plug mated with the socket. The socket and the plug are respectively provided on two circuit boards. The connection and disconnection of the two circuit boards are achieved by the mutual insertion and separation of the plug and the socket. The plug includes a pin, an insulator provided outside the pin and a first shielding shell covering outside the pin and the insulator. The socket includes an elastic contact member, an insulating seat provided outside the elastic contact member, and a second shielding shell covering outside the elastic contact member and the insulating seat. When the plug and the socket are inserted into each other, the pin and the elastic contact member are inserted and connected to each other, such that the two circuit boards are electrically connected. Meanwhile, the first shielding shell and the second shielding shell are inserted and conducted to each other, realizing the function of shielding interference signals for the pin and the elastic contact member. However, since the second shielding shell of the socket needs to be in contact with the circuit board for grounding, it is required to provide an elastic arm or a soldering leg on the second shielding shell to be electrically in contact with the circuit board. Nevertheless, whether the elastic arm or the soldering leg is provided, a large gap is inevitably formed on the second shielding shell, such that the second shielding shell cannot completely cover the elastic contact member, reducing the shielding effect. Further, when the plug and the socket are mated, the pin and the elastic contact member need to be mated, and the first shielding shell and the second shielding shell also need to be mated. However, the plug and the socket of the board-to-board connector are small, and are not easy to be mated simultaneously, which may cause the first shielding shell and the second shielding shell to be improperly mated, resulting in poor contact between the first shielding shell and the second shielding shell. Thus, the first shielding shell cannot be grounded through the second shielding shell, such that the shielding function is not provided. Moreover, the first shielding shell and the second shielding shell are both rigid. When the first shielding shell and the second shielding shell are mated, a gap is easily formed between the first shielding shell and the second shielding shell, such that a portion of the first terminal or the second terminal cannot be shielded.

Therefore, a heretofore unaddressed need to design a new connector assembly exists in the art to address the aforementioned deficiencies and inadequacies.

SUMMARY

The present invention is directed to a connector assembly easy for mating and has good shielding performance.

To achieve the foregoing objective, the present invention adopts the following technical solutions.

A connector assembly includes: a first electronic component; an electrical connector, fixed to the first electronic component, wherein the electrical connector comprises an insulating body and at least one first terminal provided on the insulating body, and the first terminal is electrically connected to the first electronic component; a second electronic component, located above the first electronic component; a mating member, fixed to the second electronic component, wherein the mating member comprises at least one second terminal fixed and electrically connected to the second electronic component, and a periphery of the second terminal is not provided with an insulating material; and at least one shielding shell, wherein an upper end and a lower end of the shielding shell respectively have a first grounding portion and a second grounding portion, the shielding shell covers outside the first terminal and is fixed to the first electronic component, the first grounding portion is electrically connected to the first electronic component, and when the mating member is downward mated with the electrical connector, the second terminal is inserted into the shielding shell to be mated and conductively connected with the first terminal, and the second grounding portion abuts the second electronic component, such that the second grounding portion is electrically connected to the second electronic component.

In certain embodiments, the shielding shell comprises a main body portion surroundingly provided outside the first terminal, an extending arm extending from an upper end of the main body portion, and at least one elastic arm bending laterally and extending from a side of the extending arm, and an upper plate edge of the elastic arm forms the second grounding portion.

In certain embodiments, the main body portion is cylindrical shaped, a lower end surface of the main body portion forms the first grounding portion, the first grounding portion is ring shaped, and a central axis of the first grounding portion coincides with a central axis of the main body portion.

In certain embodiments, the second grounding portion is arc-shaped.

In certain embodiments, the elastic arm bends laterally and extends from a side end of the extending arm around a central axis of the main body portion, a tail end surface of the elastic arm is a free end surface, and when the mating member is mated with the electrical connector, the free end surface and the side end surface of the extending arm are provided directly facing each other.

In certain embodiments, a lower plate edge of the elastic arm and a top surface of the main body portion are provided directly facing each other, and in a process of the mating member downward mating with the electrical connector, a gap between the lower plate edge of the elastic arm and the top surface of the main body portion becomes gradually smaller.

In certain embodiments, the shielding shell comprises two elastic arms and two second grounding portions, the two elastic arms form a ring shape, each of the two elastic arms is provided with one of the two second grounding portions, and the two second grounding portions also form a ring shape.

In certain embodiments, a projection of the elastic arm in a vertical direction and a projection of the main body portion in the vertical direction at least partially overlap with each other.

In certain embodiments, a bottom surface of the shielding shell is upward concavely provided with a groove, the insulating body is provided with a protruding block protruding into the groove, the groove has a narrower top and a wider bottom, an inner wall surface of the groove forms a guide chamfer, and the guide chamfer is connected between the narrower top of the inner wall surface of the groove and the wider bottom of the inner wall surface of the groove.

In certain embodiments, an upper end of an outer surface of the protruding block is arc-shaped.

In certain embodiments, a first solder pad is attached to an upper surface of the first electronic component, the first grounding portion is soldered to the first solder pad and attached to an upper surface of the first solder pad, the first grounding portion is grounded by being conductively connected with the first solder pad, and the first solder pad is ring shaped.

In certain embodiments, a second solder pad is attached to a lower surface of the second electronic component, and the second solder pad is ring shaped, and when the mating member is mated with the electrical connector, the shielding shell is grounded by the second grounding portion abutting the second solder pad, and the second grounding portion is attached to the lower surface of the second solder pad.

In certain embodiments, the first terminal comprises a soldering sheet and a first elastic contact sheet and a second elastic contact sheet respectively bending upward and extending from two sides of the soldering sheet, a bottom surface of the soldering sheet is soldered to the first electronic component, the second terminal is needle shaped, and a top surface of the second terminal is soldered to the second electronic component.

In certain embodiments, the insulating body is sleeved over the first terminal, the insulating body is provided with a through slot, and the first terminal is retained in the through slot and extends upward beyond a top surface of the insulating body.

Further, a connector assembly includes: a first electronic component; an electrical connector, fixed to the first electronic component, wherein the electrical connector comprises at least one first terminal electrically connected to the first electronic component; a second electronic component, located above the first electronic component; a mating member, fixed to the second electronic component, wherein the mating member comprises at least one second terminal electrically connected to the second electronic component; and at least one shielding shell, wherein the shielding shell is cylindrical shaped with two open ends and covers outside the first terminal, two sides of the shielding shell respectively have a first grounding portion and a second grounding portion, the first grounding portion is fixed and electrically connected to the first electronic component, the shielding shell comprises at least one elastic arm, a side wall of the shielding shell is provided with a concave region, the elastic arm is formed by providing the concave region on the side wall of the shielding shell, an upper plate edge of the elastic arm forms the second grounding portion, and when the mating member is mated with the electrical connector, the second terminal is inserted into the shielding shell to be mated and conductively connected with the first terminal, the elastic arm abuts the second electronic component and moves into the concave region, and the second grounding portion is electrically connected to the second electronic component.

In certain embodiments, the shielding shell further comprises a main body portion being closed cylindrical shaped and an extending arm extending vertically upward from a top surface of the main body portion, the elastic arm bends laterally and extends from a first side of the extending arm, and a projection of the elastic arm in a vertical direction and a projection of the main body portion in the vertical direction at least partially overlap with each other.

In certain embodiments, in a process of the mating member mating with the electrical connector, a gap between the top surface of the main body portion and a lower plate edge of the elastic arm gradually becomes smaller.

In certain embodiments, the concave region is a penetrating slot and runs through an inner surface and an outer surface of the side wall of the shielding shell, and a lower plate edge of the elastic arm, a portion of the top surface of the main body portion and a side surface of a second side of the extending arm not extending the elastic arm therefrom jointly form an inner wall surface of the concave region.

In certain embodiments, the shielding shell comprises at least two elastic arms and two second grounding portions, the elastic arms form a ring shape, an upper surface of each of the elastic arms forms one of the second grounding portions, and the second grounding portions also form a ring shape and are located on a same horizontal plane.

In certain embodiments, the first terminal comprises a soldering sheet and a first elastic contact sheet and a second elastic contact sheet respectively bending upward and extending from two sides of the soldering sheet, the soldering sheet is soldered to an upper surface of the first electronic component, and the second terminal is needle shaped and is soldered to a lower surface of the second electronic component.

In certain embodiments, the connector assembly includes a plurality of shielding shells, wherein the electrical connector comprises a plurality of first terminals, and a periphery of each of the first terminals is surroundingly provided with and enclosed by a corresponding one of the shielding shells.

Further, a connector assembly includes: a first electronic component; an electrical connector, fixed to the first electronic component, wherein the electrical connector comprises at least one first terminal electrically connected to the first electronic component; a second electronic component, located at one side the first electronic component; a mating member, fixed to the second electronic component, wherein the mating member comprises at least one second terminal electrically connected to the second electronic component; and at least one shielding shell, wherein the shielding shell is cylindrical shaped with two open ends, one end of the shielding shell has a first grounding portion, the first grounding portion is electrically connected and fixed to one of the first electronic component and the second electronic component, an elastic arm is formed by stamping from another end of the shielding shell along a side wall of the shielding shell, such that the side wall of the shielding shell forms a concave region, the elastic arm has a second grounding portion, when the mating member is mated with the electrical connector, the second grounding portion is electrically connected to the other of the first electronic component and the second electronic component, and when the mating member is mated with the electrical connector, the first terminal and the second terminal are both located in the shielding shell to perform electrical mating, the second grounding portion elastically abuts the other of the first electronic component and the second electronic component, and the elastic arm is partially accommodated in the concave region.

In certain embodiments, the shielding shell comprises a main body portion being cylindrical shaped and an extending arm extending vertically upward from a top surface of the main body portion, the elastic arm bends laterally and extends from a first side of the extending arm, and an upper plate edge of the elastic arm forms the second grounding portion.

In certain embodiments, in a process of the mating member downward mating with the electrical connector, a gap between a lower plate edge of the elastic arm and the top surface of the main body portion becomes gradually smaller.

In certain embodiments, a lower surface of the elastic arm and the top surface of the main body portion are provided directly facing each other, and the elastic arm is formed by extending around a center axis of the main body portion and extending upward.

In certain embodiments, the shielding shell comprises two elastic arms and two second grounding portions, the two elastic arms extend in a same extending direction and form a ring shape, the upper plate edge of each of the elastic arms forms one of the two second grounding portions, and the two second grounding portions also form a ring shape.

In certain embodiments, the concave region is a penetrating slot and runs through an inner surface and an outer surface of the side wall of the shielding shell, and a lower plate edge of the elastic arm, a portion of the top surface of the main body portion and a side surface of a second side of the extending arm not extending the elastic arm therefrom jointly form an inner wall surface of the concave region.

In certain embodiments, the connector assembly includes a plurality of shielding shells, wherein after the mating member is mated with the electrical connector, a periphery of each of the first terminal and second terminal inserted is surroundingly provided with and enclosed by a corresponding one of the shielding shells.

In certain embodiments, the first terminal comprises a soldering sheet and a first elastic contact sheet and a second elastic contact sheet respectively bending upward and extending from two sides of the soldering sheet, the soldering sheet is soldered to an upper surface of the first electronic component, the second terminal is needle shaped, and an end surface at one side of the second terminal is soldered to a lower surface of the second electronic component.

Compared with the related art, the connector assembly according to certain embodiments of the present invention includes a first electronic component, an electrical connector fixed to the electronic component, a shielding shell, a second electronic component and a mating member fixed to the second electronic component. The electrical connector includes at least one first terminal. The shielding shell surrounds outside the first terminal. The mating member includes at least one second terminal. The two sides of the shielding shell respectively have a first grounding portion and a second grounding portion. The first grounding portion is electrically connected to the first electronic component. When the mating member is downward mated with the mating connector, the second terminal is inserted into the shielding shell to be mated and conductively connected with the first terminal, and the second grounding portion is electrically connected to the second electronic component. In a process of the mating member mating with the electrical connector, the second grounding portion abuts the second electronic component, and the connector assembly only needs to provide with one shielding shell to perform the functions of shielding the electrical connector and the mating member. At the time of mating, only the second terminal needs to be inserted into the shielding shell to be mated and conductively connected with the first terminal, so it is easy for insertion. Further, only one shielding shell is needed to simultaneously cover the first terminal and the second terminal after mating, so there is no need to provide the insulating material for isolation at the periphery of the second terminal, and the structure is simple and the cost is saved. Moreover, the first grounding portion is electrically connected to one of the first electronic component and the second electronic component so as to be grounded, and at the time of insertion, the second grounding portion is electrically connected to the other of the first electronic component and the second electronic component so as to be grounded, such that double grounding can be achieved after mating, thereby ensuring the good grounding effect of the shielding shell. The concave region is formed on the shielding shell by stamping one end of its side wall to form the elastic arm, and the surface of the elastic arm forms the second grounding portion. When the mating member and the electrical connector are inserted into each other, the elastic arm moves into the concave region. In this case, the side wall of the shielding shell is substantially enclosed, and the two end surfaces of the shielding shell are respectively closely attached to the first electronic component and the second electronic component, such that the first terminal and the second terminal can be completely covered and the shielding effect is better.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
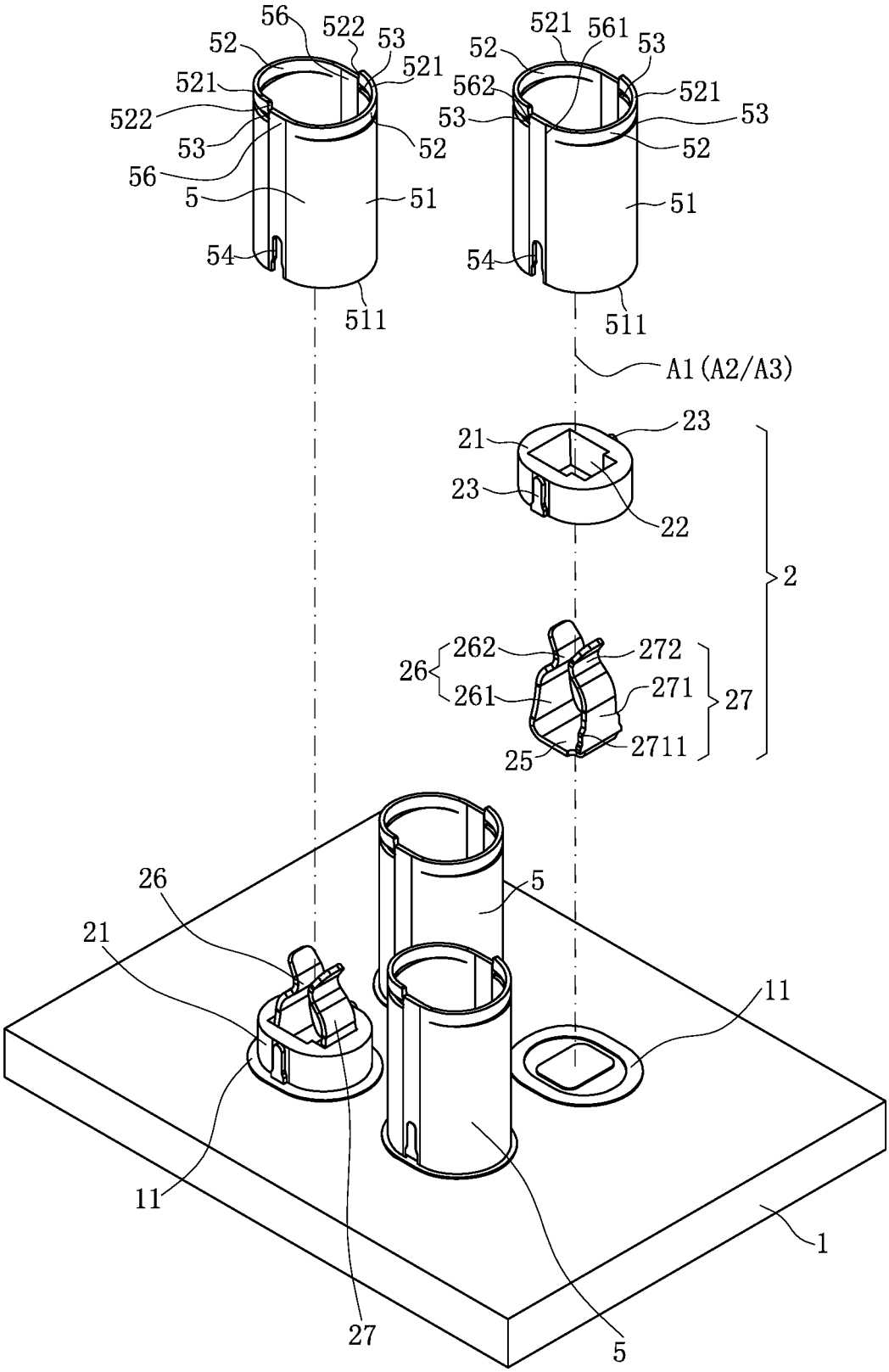
FIG. 1 is a partial perspective exploded view of a connector assembly according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a connector assembly.

Figure 5:
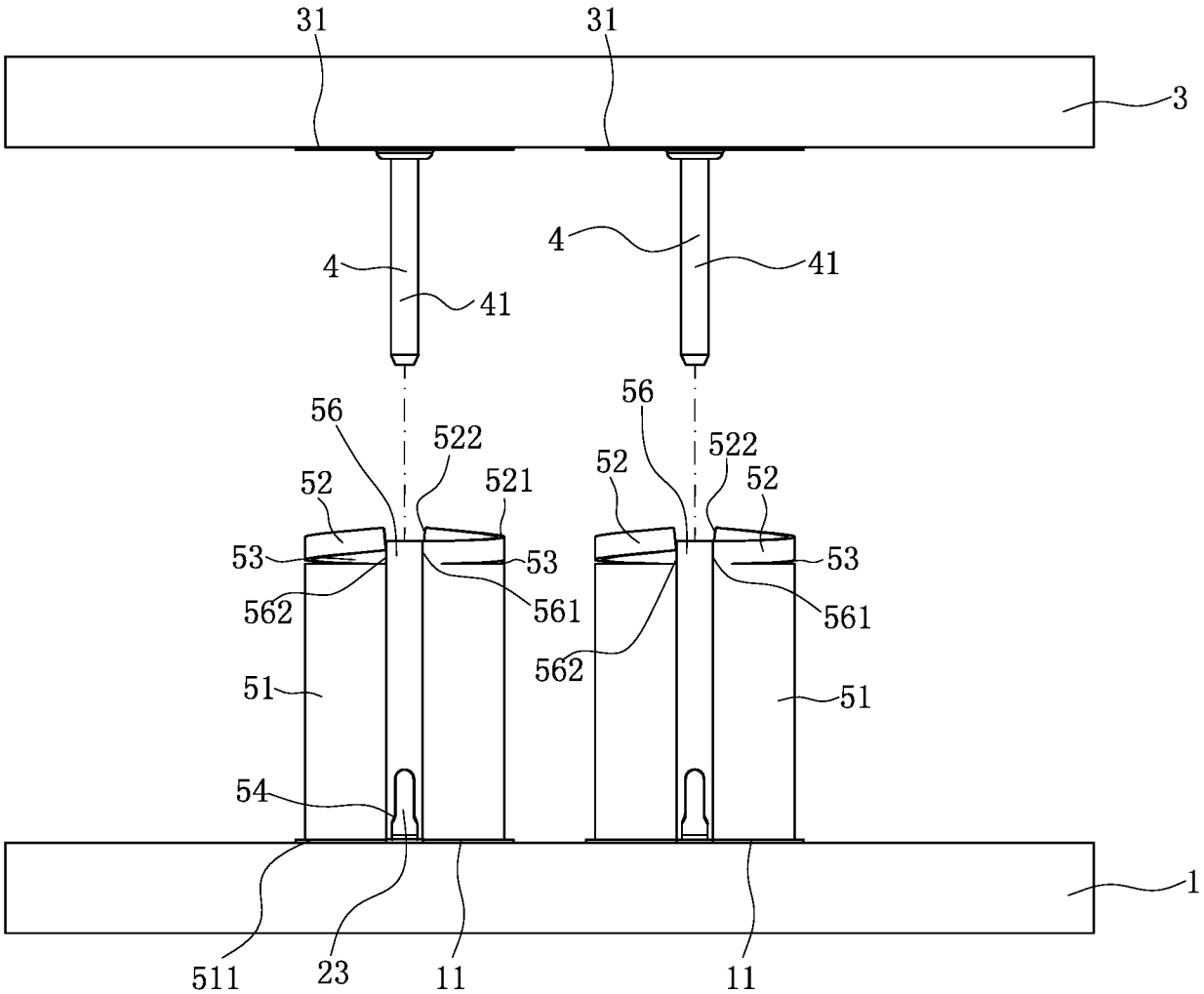
FIG. 5 is a perspective assembled view of a connector assembly according to certain embodiments of the present invention when not inserted.
Figure 6:
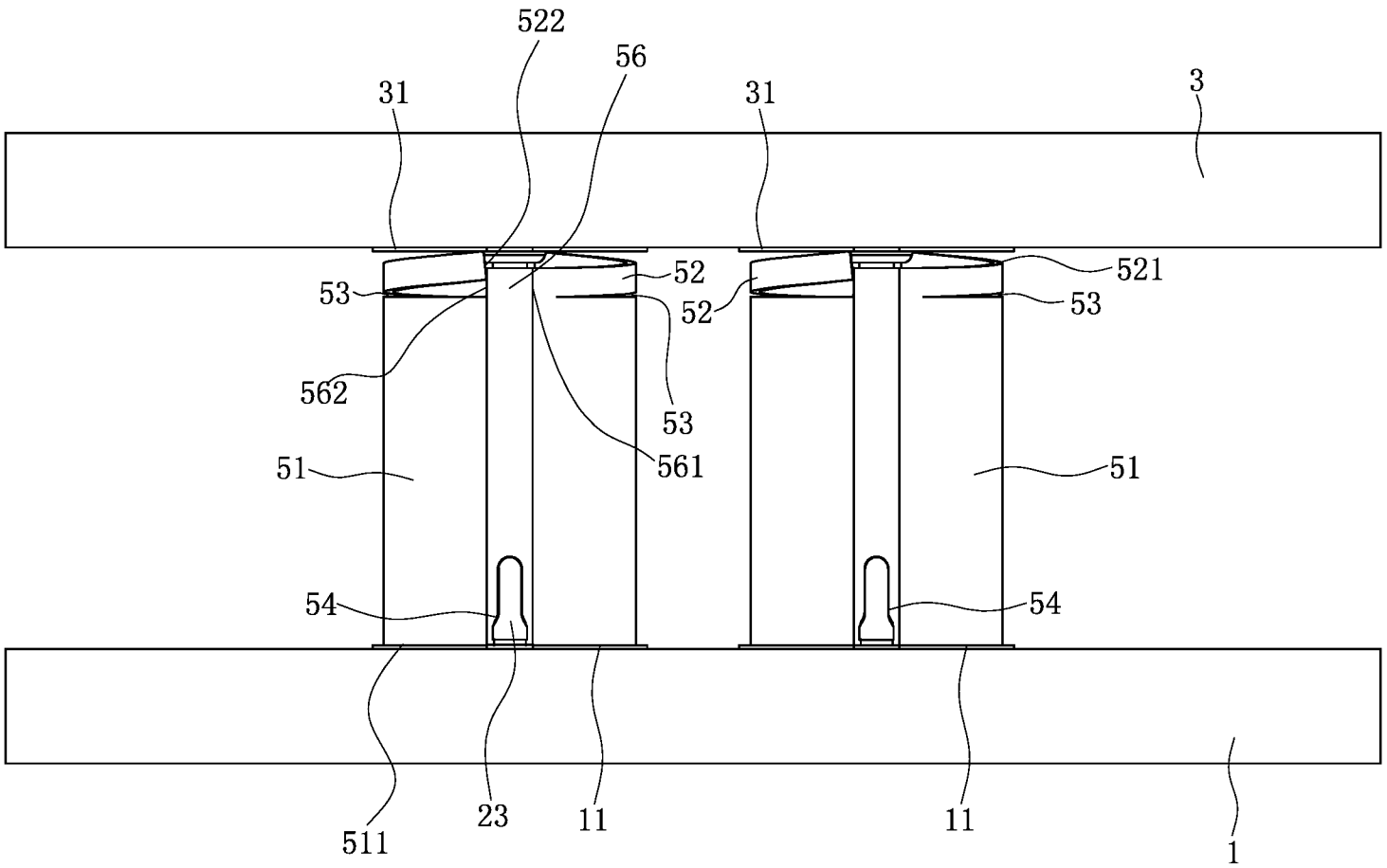
FIG. 6 is a perspective assembled view of a connector assembly according to certain embodiments of the present invention during the insertion.
Figure 7:
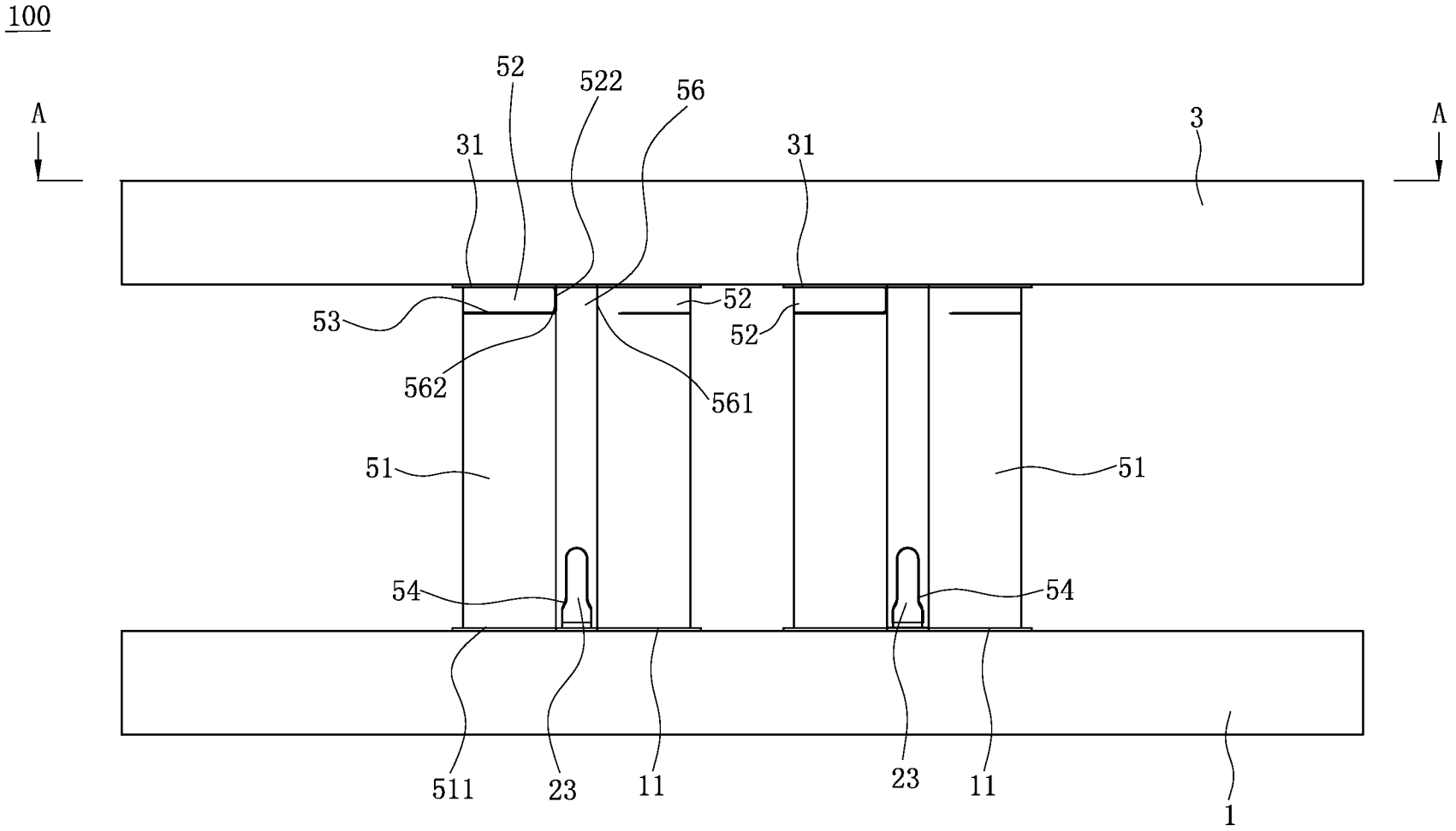
FIG. 7 is a perspective assembled view of a connector assembly according to certain embodiments of the present invention after insertion.

As shown in FIG. 1 and FIG. 5, certain embodiments of the present invention provide a connector assembly 100, including a first electronic component 1, an electrical connector 2 fixed to the first electronic component 1, a second electronic component 3, a mating member 4 fixed to the second electronic component 3, and a shielding shell 5.

The electrical connector 2 and the mating member 4 can be inserted into or separated from each other. The first electronic component 1 and the second electronic component 3 are both circuit boards, and the electrical connection and disconnection of the first electronic component 1 and the second electronic component 3 are achieved by the insertion and separation of the electrical connector 2 and the mating member 4. A surface of the first electronic component 1 has a first solder pad 11. A surface of the second electronic component 3 has a second solder pad 31, and the second solder pad 31 is ring shaped. Alternatively, the first solder pad 11 may be provided in a hole formed on the first electronic component 1 itself, and the second solder pad 31 may also be provided in a hole formed on the second electronic component 3 itself. The first solder pad 11 is conductively connected with a grounding path of the first electronic component 1, and the second solder pad 31 is conductively connected with a grounding path of the second electronic component 3. For convenience of description, the second electronic component 3 according to certain embodiments of the present invention is located above the first electronic component 1, and may alternatively be placed in other directions.

Figure 8:
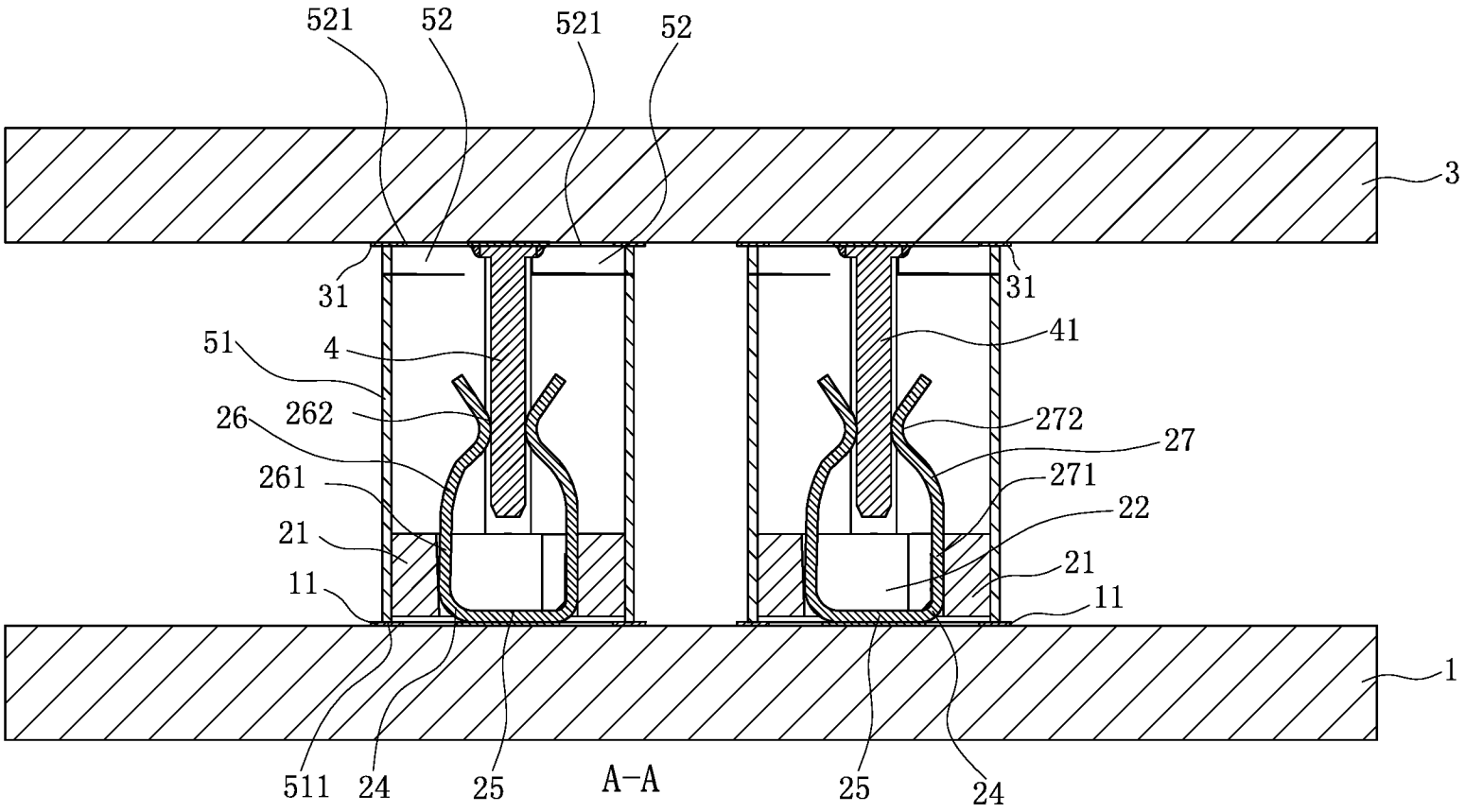
FIG. 8 is a sectional view of a connector assembly according to certain embodiments of the present invention after insertion.

As shown in FIG. 1 and FIG. 8, the mating member 4 includes a second terminal 41, and the second terminal 41 is fixed to the second electronic component 3. In this embodiment, the second terminal 41 is needle shaped, and a top surface of the second terminal 41 is soldered to a lower surface of the second electronic component 3. A periphery of the second terminal 41 is not provided with any insulating material. In this embodiment, the periphery of the second terminal 41 is not provided with any metal material having a shielding effect.

As shown in FIG. 1 and FIG. 8, the electrical connector 2 includes an insulating body 21 and a first terminal 24 provided in the insulating body 21. One side of the free end of the second terminal 41 is used to be mated with the first terminal 24 for electrical conduction. The insulating body 21 is elliptical cylindrical shaped. A bottom surface of the insulating body 21 is attached to an upper surface of the first electronic component 1. The insulating body 21 is provided with a through slot 22, and the through slot 22 runs through an upper surface and a lower surface of the insulating body 21. Two protruding blocks 23 protrude outward from the outer side surfaces of the insulating body 21. The first terminal 24 is retained in the through slot 22. The first terminal 24 is inserted into the through slot 22 and extends upward beyond the upper surface of the insulating body 21. The first terminal 24 is formed by an elastic metal sheet. The first terminal 24 includes a soldering sheet 25 formed by horizontally extending, and a first contact sheet 26 and a second contact sheet 27 respectively being elastic and bending and extending upward from a left side and a right side of the soldering sheet 25. The soldering sheet 25 is soldered to the upper surface of the first electronic component 1 to be electrically conducted with the first electronic component 1.

The first contact sheet 26 has a first body sheet 261 bending and extending upward from one end of the soldering sheet 25, and a first contact portion 262 bending and extending from the first body sheet 261 toward the second contact sheet 27 and then bending and extending away from the second contact sheet 27. The second contact sheet 27 has a second body sheet 271 bending and extending upward from the other end of the soldering sheet 25, and a second contact portion 272 bending and extending from the second body sheet 271 toward the first contact sheet 26 and then bending and extending away from the first contact sheet 26. The first contact portion 262 and the second contact portion 272 are provided symmetrically in the left-right direction, and a minimum distance between the first contact portion 262 and the second contact portion 272 is smaller than a width of the second terminal 41. Thus, during the insertion between the electrical connector 2 and the mating member 4, when the second terminal 41 is inserted between the first contact sheet 26 and the second contact sheet 27 of the first terminal 24, the second terminal 41 can widen the gap between the first contact portion 262 and the second contact portion 272, which are elastic. Moreover, the stable contact of the second terminal 41 with the first contact portion 262 and the second contact portion 272 and the good electrical conduction between the first terminal 24 and the second terminal 41 achieve the electrical conduction between the first electronic component 1 and the second electronic component 3. After the mating member 4 is mated with the electrical connector 2, the first contact sheet 26 and the second contact sheet 27, which are elastic, jointly clamp the second terminal 41. Thus, when the socket is disconnected from the plug, the second terminal 41 can be easily separated from the first terminal 24, so as to achieve the electrical disconnection between the first electronic component 1 and the second electronic component 3.

Figure 3:
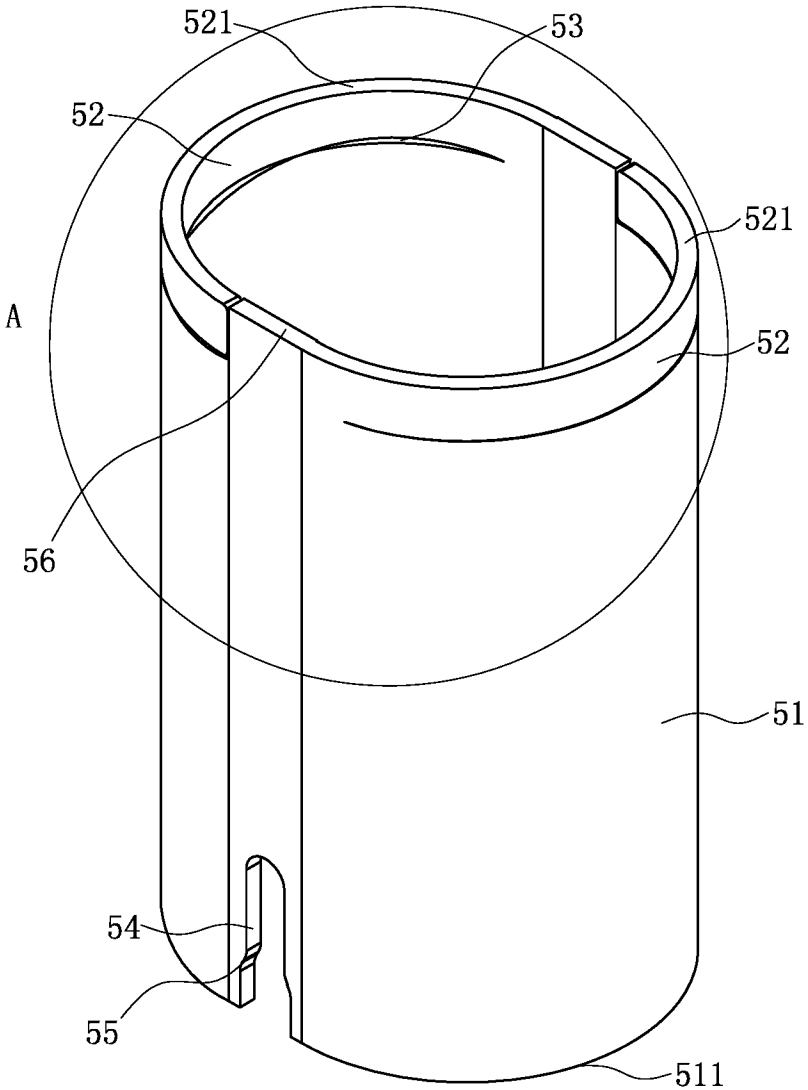
FIG. 3 is a perspective view of a shielding shell of a connector assembly according to certain embodiments of the present invention.
Figure 4:
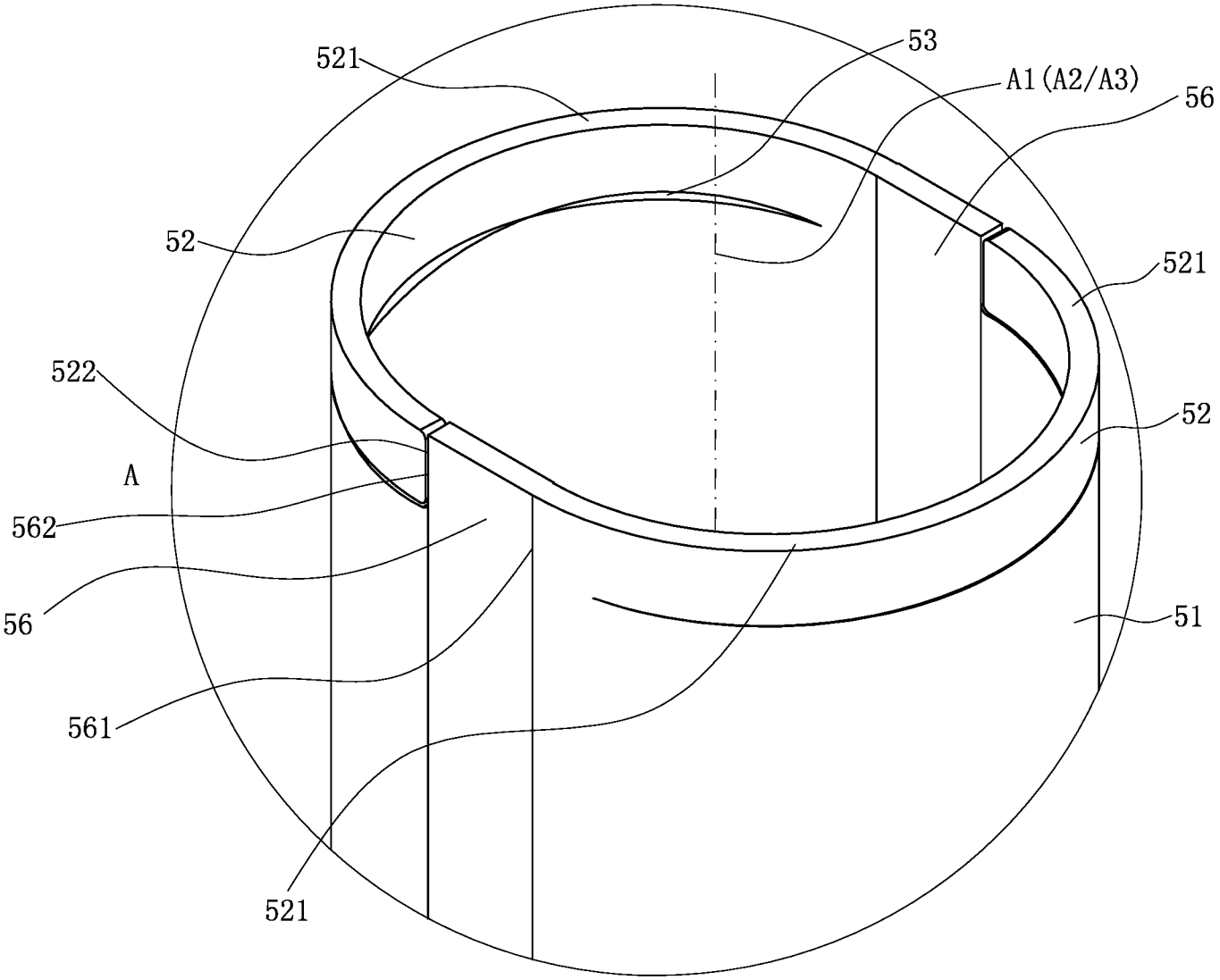
FIG. 4 is a partial enlarged view of FIG. 3.

As shown in FIG. 3, FIG. 4 and FIG. 8, the shielding shell 5 is made of metal, and the shielding shell 5 is cylindrical shaped with open upper and lower ends. The shielding shell 5 includes a main body portion 51 which is closed cylindrical shaped, two extending arms 56 extending vertically upward from the upper end of the main body portion 51, and two elastic arms 52. Each elastic arm 52 bends laterally and extends from a first side 561 of each of the extending arms 56, and the two elastic arms 52 extend in the same direction. The two elastic arms 52 define a ring shape. Each elastic arm 52 is formed by extending around a central axis A1 of the main body portion 51 and extending upward. A width of an upper plate edge of each elastic arm 52 is smaller than a width of a side plate surface of each elastic arm 52, and the width of the upper plate edge of each elastic arm 52 is identical to a width of a top surface of the main body portion 51. A side wall surface of the elastic arm 52 and the side wall of the main body portion 51 are substantially located on a same arc-shaped surface. A lower plate edge of each elastic arm 52 directly faces the top surface of the main body portion 51 vertically. That is, a projection of the lower plate edge of the elastic arm 52 coincides with a projection of the top surface of the main body portion 51 onto a horizontal plane. A projection of the elastic arm 52 in a vertical direction at least partially overlaps with a projection of the main body portion 51 in the vertical direction. In certain embodiments, two elastic arms 52 are provided. When the circumference of the main body portion 51 is a constant, a length of each elastic arm 52 is longer, such that the second grounding portion 521 is longer and has a larger contact area with the second electronic component 3, which also facilitates a more enclosed covering on the periphery of the first terminal 24 and second terminal 41 after being mated. In other embodiments, it is also possible that either only one elastic arm 52 is provided, or three or more elastic arms 52 are provided. The elastic arms 52 are only provided at an upper end of the shielding shell 5, and the bottom surface of the shielding shell 5, i.e., the bottom surface of the main body portion 51, is provided in parallel with the horizontal plane, such that the bottom surface of the shielding shell 5 is soldered to the horizontal upper surface of the first electronic component 1. Thus, there is no gap between the shielding shell 5 and the first electronic component 1, and the shielding shell 5 can surround the outside of the first terminal 24 in an enclosed way. The shielding shell 5 can realize the function of shielding signals when being grounded. The elastic arms 52 are formed by stamping from one end of the shielding shell 5 along its side wall, such that two concave regions 53 are formed on the side wall of the shielding shell 5. Each concave region 53 runs through an inner surface and an outer surface of the side wall of the shielding shell 5. The lower plate edge of each elastic arm 52, a portion of the top surface of the main body portion 51 and a side surface of a second side 562 of the extending arm 56 with no elastic arm 52 extending therefrom jointly form the inner wall surface of the corresponding concave region 53. The bottom surface of the shielding shell 5 is soldered to the first electronic component 1. The two elastic arms 52 extend in the same direction. Each elastic arm 52 is formed by extending around the central axis A1 of the main body portion 51 and extending upward. When viewing downward from the top thereof, the extending direction of the two elastic arms 52 rotates in the counterclockwise direction. Each elastic arm 52 is formed by bending laterally and extending around the central axis A1 of the main body portion 51 from the side end of the extending arm 56, and the tail end surface of each elastic arm 52 is a free end surface 522. After the mating member 4 is mated with the electrical connector 2, the free end surface 522 directly faces the side end surface of the extending arm 56, instead of being staggeredly provided. Thus, there is substantially no gap between the elastic arm 52 and the main body portion 51 along the horizontal plane, such that the shielding shell 5 can cover the electrical connector 2 and the mating member 4 in a more enclosed way. The elastic arms 52 are located closer to the first terminal 24 and the second terminal 41, and thus, the shielding effect is better. The upper and lower ends of the shielding shell 5 respectively have a first grounding portion 511 and a second grounding portion 521. The lower end surface of the shielding shell 5, i.e., the bottom surface of the main body portion 51, forms the first grounding portion 511. The upper plate edge of each elastic arm 52 forms the second grounding portion 521, and each of the elastic arms 52 is provided with one second grounding portion 521. The two second grounding portions 521 also define a ring shape. A central axis A3 of the ring shape defined by the second grounding portions 521 coincides with the central axis A1 of the main body portion 51. The first grounding portion 511 is electrically conducted with a grounding path of the first electronic component 1 by being soldered to the first solder pad 11 of the first electronic component 1. The first grounding portion 511 is in a substantially enclosed ring shape. The central axis A2 of the first grounding portion 511 coincides with the central axis A1 of the main body portion 51, such that the lower end of the main body portion 51 does not need to be torn to form elastic sheets for abutting the first electronic component 1. That is, the shielding shell 5 and the first electronic component 1 can be connected in a substantially enclosed way, such that the first terminal 24 is not exposed to the shielding shell 5, the shielding shell 5 can completely cover the first terminal 24, and the shielding effect is better. Further, the shielding shell 5 covers outside the first terminal 24 and the insulating body 21, and the top end surface of the main body portion 51 passes beyond the top end surface of the first terminal 24, which facilitates the insertion of the second terminal 41 into the shielding shell 5. Moreover, after the insertion, the shielding shell 5 can completely cover outside the second terminal 41, such that there is no gap between the shielding shell 5 and the second electronic component 3, and the shielding effect is better. Multiple shielding shells 5 are provided. Each of the shielding shells 5 surrounds one of the first terminals 24. After the mating member 4 is mated with the electrical connector 2, each of the shielding shells 5 surrounds the first terminal 24 and the second terminal 41 being mated.

The shielding shell 5 further includes two grooves 54 upward concavely provided on a bottom surface thereof. The two grooves 54 respectively form interference fit with the protruding blocks 23 protruding from the insulating body 21. Each groove 54 has a narrower top and a wider bottom, and an inner wall surface of each groove 54 forms a guide chamfer 55. The guide chamfer 55 is connected between the narrower inner wall surface of the groove 54 and the wider inner wall surface of the groove 54. The upper end of the outer surface of each protruding block 23 is arc-shaped, which facilitates the insertion into the groove 54.

Figure 2:
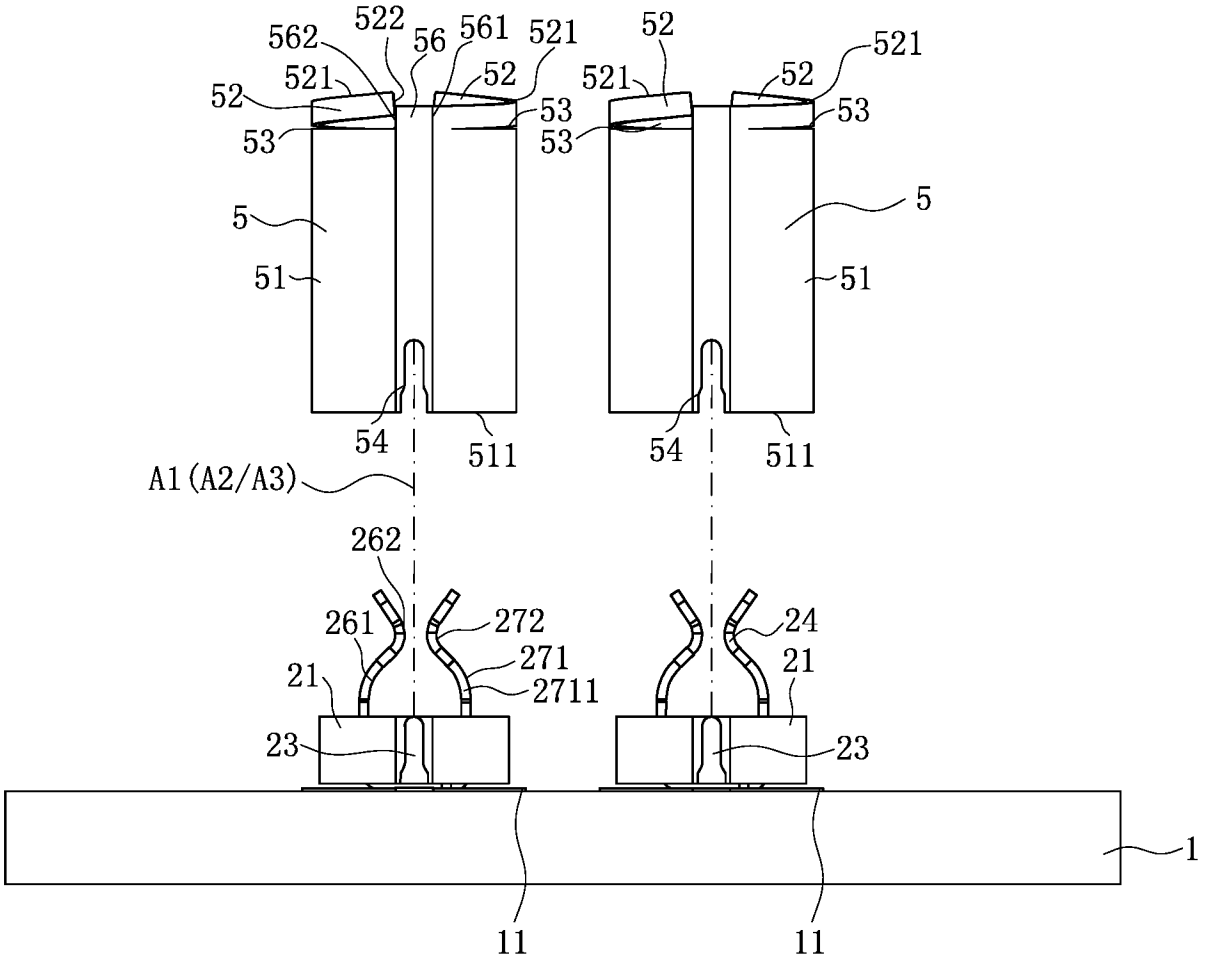
FIG. 2 is a partial perspective exploded view of a connector assembly according to certain embodiments of the present invention from another viewing angle.

As shown in FIG. 1 and FIG. 2, when the electrical connector 2 is assembled to the first electronic component 1, the soldering sheet 25 of the first terminal 24 is firstly soldered to the first electronic component 1, and then the insulating body 21 is sleeved over the first terminal 24 downward from top thereof. The second body sheet 271 of the first terminal 24 is protrudingly provided with multiple protrusions 2711 in strong interference fit with the inner wall surface of the through slot 22 of the insulating body 21. A portion of the bottom surface of the insulating body 21 is pressed on the soldering sheet 25, such that the insulating body 21 can be firmly fastened outside the first terminal 24. Finally, the shielding shell 5 is sleeved over the first terminal 24 and the insulating body 21 downward from top thereof, such that the one end of the shielding shell 5 having the elastic arms 52 faces upward, and the protrusions 2711 of the insulating body 21 protrude into the grooves 54 of the shielding shell 5 to prevent the shielding shell 5 from rotating. Then, the bottom surface of the shielding shell 5 is soldered to the first solder pad 11 of the first electronic component 1. The first solder pad 11 is attached to the upper surface of the first electronic component 1, and the first grounding portion 511 is attached to the upper surface of the first solder pad 11. The first grounding portion 511 and the first solder pad 11 are both ring shaped. In other embodiments, the shielding shell 5 may be only in electrical contact with the first solder pad 11 without soldering, and is only retained on the insulating body 21. In this case, the electrical connector 2 and the shielding shell 5 are fixed to the first electronic component 1, such that when the electrical connector 2 and the mating member 4 are inserted and separated, the electrical connector 2 can move together with the first electronic component 1 and the shielding shell 5 as a whole. The mating member 4 and the second electronic component 3 are fixed as a whole, and move together when being inserted and separated.

As shown in FIG. 5, FIG. 6, FIG. 7 and FIG. 8, when the mating member 4 moves downward to be mated with the electrical connector 2, the second terminal 41 is inserted downward into the shielding shell 5 to be inserted into the first terminal 24 for electrical conduction, and the second electronic component 3 is pressed downward on the elastic arms 52, such that the elastic arms 52 upward abut the second electronic component 3. In this process, the second electronic component 3 presses the elastic arms 52 into the concave regions 53, and the elastic arms 52 move to be partially located in the concave regions 53. The upper surface of each elastic arm 52 abuts the second solder pad 31 of the second electronic component 3. That is, the second grounding portion 521 is electrically conducted with the second solder pad 31. The second grounding portion 521 is conducted with the grounding path of the second electronic component 3 by contacting the second solder pad 31. The lower plate edge of the elastic arm 52 directly faces the top surface of the main body portion 51 instead of being staggeredly provided, such that a distance from each elastic arm 52 to the first terminal 24 and the second terminal 41 is smaller, thereby shielding the signals better. When the mating member 4 is downward mated with the electrical connector 2, the gap between the lower plate edge of each elastic arm 52 and the top surface of the main body portion 51 gradually becomes smaller. After the mating member 4 is mated with the electrical connector 2 downward, the elastic arms 52 partially enter the concave regions 53, such that the gap between the lower plate edge of each elastic arm 52 and the top surface of the main body portion 51 becomes smaller, the shielding shell 5 becomes more enclosed, and the shielding effect becomes better. In this case, the shielding shell 5 is basically closed cylindrical shaped. The top surface of the shielding shell 5, i.e., the upper plate edge of the elastic arm 52 is closely attached to the lower surface of the second electronic component 3. The bottom surface of the shielding shell 5 is closely attached to the upper surface of the first electronic component 1. The side walls of the shielding shell 5 are formed by the side wall of the main body portion 51, the side walls of the extending arms 56 and the side walls of the elastic arms 52, and the side wall of the shielding shell 5 is substantially enclosed, so as to well reduce the loss of signals of the connector assembly 100. Moreover, the first grounding portion 511 of the shielding shell 5 is in contact with the first electronic component 1 to be grounded, and the second grounding portion 521 is in contact with the second electronic component 3 to be grounded, so as to ensure good grounding of the shielding shell 5. Thus, the shielding shell 5 has a good shielding effect on the mating member 4 and the electrical connector 2.

The projection of each elastic arm 52 in the vertical direction at least partially overlaps with the projection of the main body portion 51 in the vertical direction. Theoretically, the projection of the elastic arm 52 in the vertical direction completely coincides with the projection of the main body portion 51 in the vertical direction. However, in practice, the elastic arm 52 is inevitably slightly closer to or farther from the central axis A1 of the main body portion 51, causing the projection of the elastic arm 52 in the vertical direction to partially coincide with the projection of the main body portion 51 in the vertical direction. Each of the first grounding portion 511 and the second grounding portion 521 is arc-shaped. After the mating member 4 is mated with the electrical connector 2, the first grounding portions 511 of the two elastic arms 52 are located on the same horizontal plane and define a ring shape. The periphery of each of the first terminals 24 is surrounded by one of the shielding shells 5. After the mating member 4 is mated with the electrical connector 2, the first grounding portion 511 and the second grounding portion 521 respectively become an upper surface and a lower surface of the symmetrical main body portion 51.

After the mating member 4 and the electrical connector 2 are inserted into each other, the shielding shell 5 being fixed to the first electronic component 1 can completely cover outside the second terminal 41 to realize a good shielding effect for the second terminal 41, such that the mating member 4 does not need to additionally provide a metal shell for shielding outside the second terminal 41. Therefore, there is no need to provide an insulating material for isolating the second terminal 41 on the periphery of the second terminal 41. Instead, the second terminal 41 is directly soldered to the second electronic component 3. Thus, the structure is simple, the material is saved, the cost is lowered, the shielding effect is better, and the insertion and separation between the mating member 4 and the electrical connector 2 become more convenient and simple.

In other embodiments, the shielding shell 5 may also be provided such that the end having the elastic arms 52 faces downward, and the end of the shielding shell 5 not provided with the elastic arms 52 is soldered to the second electronic component 3 and surrounds the outside of the second terminal 41. The shielding shell 5 is also not provided with the grooves 54, and no protruding block 23 protrudes from the insulating body 21 outside the first terminal 24. That is, the shielding shell 5 is fixed to the second electronic component 3. When the mating member 4 and the electrical connector 2 are inserted into each other, the first terminal 24 is inserted into the shielding shell 5 to be mated with the second terminal 41 for electrical conduction, the elastic arms 52 are pressed by the first electronic component 1, and the elastic arms 52 abut the first electronic component 1.

To sum up, the connector assembly according to certain embodiments of the present invention has the following beneficial effects:

(1) The connector assembly 100 includes a first electronic component 1, an electrical connector 2 fixed to the electronic component 1, a shielding shell 5, a second electronic component 3 and a mating member 4 fixed to the second electronic component 3. The electrical connector 2 includes at least one first terminal 24. The shielding shell 5 surrounds outside the first terminal 24. The mating member 4 includes at least one second terminal 41. The upper and lower ends of the shielding shell 5 respectively have a first grounding portion 511 and a second grounding portion 521. The first grounding portion 511 is electrically connected to the first electronic component 1. When the mating member 4 is downward mated with the mating connector, the second terminal 41 is inserted into the shielding shell 5 to be mated and conductively connected with the first terminal 24, and the second grounding portion 521 is electrically connected to the second electronic component 3. In a process of the mating member 4 mating with the electrical connector 2, the second grounding portion 521 abuts the second electronic component 3, and the connector assembly 100 only needs to provide with one shielding shell 5 to perform the functions of shielding the electrical connector 2 and the mating member 4. At the time of mating, only the second terminal 41 needs to be inserted into the shielding shell 5 to be mated and conductively connected with the first terminal 24, so it is easy for insertion. Further, the shielding shell 5 is provided on one of the electrical connector 2 and the mating member 4 to simultaneously cover the first terminal 24 and the second terminal 41 after mating, so there is no need to provide the insulating material for isolation at the periphery of the second terminal 41, and the structure is simple and the cost is saved.

(2) The first grounding portion 511 is electrically connected to one of the first electronic component 1 and the second electronic component 3 so as to be grounded, and when the electrical connector 2 and the mating member 4 are inserted into each other, the second grounding portion 521 is electrically connected to the other of the first electronic component 1 and the second electronic component 3 so as to be grounded, such that the shielding shell 5 can be double grounded after the electrical connector 2 is mated with the mating member 4, thereby ensuring the good grounding effect of the shielding shell 5.

(3) The concave region 53 is formed on the shielding shell 5 by stamping one end of its side wall to form the elastic arm 52. The bottom surface of the shielding shell 5 forms the first grounding portion 511, and the top end surface of the shielding shell 5, i.e., the lower plate edge of the elastic arm 52, forms the second grounding portion 521. When the mating member 4 and the electrical connector 2 are inserted into each other, the elastic arm 52 moves into the concave region 53. In this case, the gap between the lower plate edge of the elastic arm 52 and the top surface of the main body portion 51 is very small, and the shielding shell 5 is substantially enclosed and can completely cover the first terminal 24 and the second terminal 41, such that the shielding effect of the shielding shell 5 is better.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector assembly, comprising:

a first electronic component;

an electrical connector, fixed to the first electronic component, wherein the electrical connector comprises an insulating body and at least one first terminal provided on the insulating body, and the first terminal is electrically connected to the first electronic component;

a second electronic component, located above the first electronic component;

a mating member, fixed to the second electronic component, wherein the mating member comprises at least one second terminal fixed and electrically connected to the second electronic component, and a periphery of the second terminal is not provided with an insulating material; and at least one shielding shell, wherein an upper end and a lower end of the shielding shell respectively have a first grounding portion and a second grounding portion, the shielding shell covers outside the first terminal and is fixed to the first electronic component, the first grounding portion is electrically connected to the first electronic component, and when the mating member is downward mated with the electrical connector, the second terminal is inserted into the shielding shell to be mated and conductively connected with the first terminal, and the second grounding portion abuts the second electronic component, such that the second grounding portion is electrically connected to the second electronic component.

2. The connector assembly according to claim 1, wherein the shielding shell comprises a main body portion surroundingly provided outside the first terminal, an extending arm extending from an upper end of the main body portion, and at least one elastic arm bending laterally and extending from a side of the extending arm, and an upper plate edge of the elastic arm forms the second grounding portion.

3. The connector assembly according to claim 2, wherein the main body portion is cylindrical shaped, a lower end surface of the main body portion forms the first grounding portion, the first grounding portion is ring shaped, and a central axis of the first grounding portion coincides with a central axis of the main body portion.

4. The connector assembly according to claim 2, wherein the second grounding portion is arc-shaped.

5. The connector assembly according to claim 2, wherein the elastic arm bends laterally and extends from a side end of the extending arm around a central axis of the main body portion, a tail end surface of the elastic arm is a free end surface, and when the mating member is mated with the electrical connector, the free end surface and the side end surface of the extending arm are provided directly facing each other.

6. The connector assembly according to claim 2, wherein a lower plate edge of the elastic arm and a top surface of the main body portion are provided directly facing each other, and in a process of the mating member downward mating with the electrical connector, a gap between the lower plate edge of the elastic arm and the top surface of the main body portion becomes gradually smaller.

7. The connector assembly according to claim 2, wherein the shielding shell comprises two elastic arms and two second grounding portions, the two elastic arms form a ring shape, each of the two elastic arms is provided with one of the two second grounding portions, and the two second grounding portions also form a ring shape.

8. The connector assembly according to claim 2, wherein a projection of the elastic arm in a vertical direction and a projection of the main body portion in the vertical direction at least partially overlap with each other.

9. The connector assembly according to claim 1, wherein a bottom surface of the shielding shell is upward concavely provided with a groove, the insulating body is provided with a protruding block protruding into the groove, the groove has a narrower top and a wider bottom, an inner wall surface of the groove forms a guide chamfer, and the guide chamfer is connected between the narrower top of the inner wall surface of the groove and the wider bottom of the inner wall surface of the groove.

10. The connector assembly according to claim 9, wherein an upper end of an outer surface of the protruding block is arc-shaped.

11. The connector assembly according to claim 1, wherein a first solder pad is attached to an upper surface of the first electronic component, the first grounding portion is soldered to the first solder pad and attached to an upper surface of the first solder pad, the first grounding portion is grounded by being conductively connected with the first solder pad, and the first solder pad is ring shaped.

12. The connector assembly according to claim 1, wherein a second solder pad is attached to a lower surface of the second electronic component, and the second solder pad is ring shaped, and when the mating member is mated with the electrical connector, the shielding shell is grounded by the second grounding portion abutting the second solder pad, and the second grounding portion is attached to the lower surface of the second solder pad.

13. The connector assembly according to claim 1, wherein the first terminal comprises a soldering sheet and a first elastic contact sheet and a second elastic contact sheet respectively bending upward and extending from two sides of the soldering sheet, a bottom surface of the soldering sheet is soldered to the first electronic component, the second terminal is needle shaped, and a top surface of the second terminal is soldered to the second electronic component.

14. The connector assembly according to claim 1, wherein the insulating body is sleeved over the first terminal, the insulating body is provided with a through slot, and the first terminal is retained in the through slot and extends upward beyond a top surface of the insulating body.

15. A connector assembly, comprising:

a first electronic component;

an electrical connector, fixed to the first electronic component, wherein the electrical connector comprises at least one first terminal electrically connected to the first electronic component;

a second electronic component, located above the first electronic component;

a mating member, fixed to the second electronic component, wherein the mating member comprises at least one second terminal electrically connected to the second electronic component; and at least one shielding shell, wherein the shielding shell is cylindrical shaped with two open ends and covers outside the first terminal, two sides of the shielding shell respectively have a first grounding portion and a second grounding portion, the first grounding portion is fixed and electrically connected to the first electronic component, the shielding shell comprises at least one elastic arm, a side wall of the shielding shell is provided with a concave region, the elastic arm is formed by providing the concave region on the side wall of the shielding shell, an upper plate edge of the elastic arm forms the second grounding portion, and when the mating member is mated with the electrical connector, the second terminal is inserted into the shielding shell to be mated and conductively connected with the first terminal, the elastic arm abuts the second electronic component and moves into the concave region, and the second grounding portion is electrically connected to the second electronic component.

16. The connector assembly according to claim 15, wherein the shielding shell further comprises a main body portion being closed cylindrical shaped and an extending arm extending vertically upward from a top surface of the main body portion, the elastic arm bends laterally and extends from a first side of the extending arm, and a projection of the elastic arm in a vertical direction and a projection of the main body portion in the vertical direction at least partially overlap with each other.

17. The connector assembly according to claim 16, wherein in a process of the mating member mating with the electrical connector, a gap between the top surface of the main body portion and a lower plate edge of the elastic arm gradually becomes smaller.

18. The connector assembly according to claim 16, wherein the concave region is a penetrating slot and runs through an inner surface and an outer surface of the side wall of the shielding shell, and a lower plate edge of the elastic arm, a portion of the top surface of the main body portion and a side surface of a second side of the extending arm not extending the elastic arm therefrom jointly form an inner wall surface of the concave region.

19. The connector assembly according to claim 15, wherein the shielding shell comprises at least two elastic arms and two second grounding portions, the elastic arms form a ring shape, an upper surface of each of the elastic arms forms one of the second grounding portions, and the second grounding portions also form a ring shape and are located on a same horizontal plane.

20. The connector assembly according to claim 15, wherein the first terminal comprises a soldering sheet and a first elastic contact sheet and a second elastic contact sheet respectively bending upward and extending from two sides of the soldering sheet, the soldering sheet is soldered to an upper surface of the first electronic component, and the second terminal is needle shaped and is soldered to a lower surface of the second electronic component.

21. The connector assembly according to claim 15, comprising a plurality of shielding shells, wherein the electrical connector comprises a plurality of first terminals, and a periphery of each of the first terminals is surroundingly provided with and enclosed by a corresponding one of the shielding shells.

22. A connector assembly, comprising:

a first electronic component;

an electrical connector, fixed to the first electronic component, wherein the electrical connector comprises at least one first terminal electrically connected to the first electronic component;

a second electronic component, located at one side the first electronic component;

a mating member, fixed to the second electronic component, wherein the mating member comprises at least one second terminal electrically connected to the second electronic component; and at least one shielding shell, wherein the shielding shell is cylindrical shaped with two open ends, one end of the shielding shell has a first grounding portion, the first grounding portion is electrically connected and fixed to one of the first electronic component and the second electronic component, an elastic arm is formed by stamping from another end of the shielding shell along a side wall of the shielding shell, such that the side wall of the shielding shell forms a concave region, the elastic arm has a second grounding portion, when the mating member is mated with the electrical connector, the second grounding portion is electrically connected to the other of the first electronic component and the second electronic component, and when the mating member is mated with the electrical connector, the first terminal and the second terminal are both located in the shielding shell to perform electrical mating, the second grounding portion elastically abuts the other of the first electronic component and the second electronic component, and the elastic arm is partially accommodated in the concave region.

23. The connector assembly according to claim 22, wherein the shielding shell comprises a main body portion being cylindrical shaped and an extending arm extending vertically upward from a top surface of the main body portion, the elastic arm bends laterally and extends from a first side of the extending arm, and an upper plate edge of the elastic arm forms the second grounding portion.

24. The connector assembly according to claim 23, wherein in a process of the mating member downward mating with the electrical connector, a gap between a lower plate edge of the elastic arm and the top surface of the main body portion becomes gradually smaller.

25. The connector assembly according to claim 23, wherein a lower surface of the elastic arm and the top surface of the main body portion are provided directly facing each other, and the elastic arm is formed by extending around a center axis of the main body portion and extending upward.

26. The connector assembly according to claim 23, wherein the shielding shell comprises two elastic arms and two second grounding portions, the two elastic arms extend in a same extending direction and form a ring shape, the upper plate edge of each of the elastic arms forms one of the two second grounding portions, and the two second grounding portions also form a ring shape.

27. The connector assembly according to claim 23, wherein the concave region is a penetrating slot and runs through an inner surface and an outer surface of the side wall of the shielding shell, and a lower plate edge of the elastic arm, a portion of the top surface of the main body portion and a side surface of a second side of the extending arm not extending the elastic arm therefrom jointly form an inner wall surface of the concave region.

28. The connector assembly according to claim 22, comprising a plurality of shielding shells, wherein after the mating member is mated with the electrical connector, a periphery of each of the first terminal and second terminal inserted is surroundingly provided with and enclosed by a corresponding one of the shielding shells.

29. The connector assembly according to claim 22, wherein the first terminal comprises a soldering sheet and a first elastic contact sheet and a second elastic contact sheet respectively bending upward and extending from two sides of the soldering sheet, the soldering sheet is soldered to an upper surface of the first electronic component, the second terminal is needle shaped, and an end surface at one side of the second terminal is soldered to a lower surface of the second electronic component.

* * * * *